United States Patent [19]

Savard et al.

[11] Patent Number: 4,614,216

[45] Date of Patent: Sep. 30, 1986

[54] METHOD OF AND APPARATUS FOR CASTING METAL USING CARBON DIOXIDE TO FORM GAS SHIELD

[75] Inventors: Guy Savard, Westmount; Robert Lee, Montreal, both of Canada

[73] Assignee: Canadian Liquid Air Ltd./Air Liquide Canada LTEE, Quebec, Canada

[21] Appl. No.: 703,751

[22] Filed: Feb. 21, 1985

[30] Foreign Application Priority Data

Feb. 24, 1984 [CA] Canada ..... 448241

[51] Int. Cl.[4] ..... B22D 7/00; B22D 11/10; B22D 27/00

[52] U.S. Cl. ..... 164/67.1; 164/66.1; 164/259; 164/415; 164/475

[58] Field of Search ..... 164/67.1, 66.1, 475, 164/259, 415; 222/603, 590, 591

[56] References Cited

U.S. PATENT DOCUMENTS

| | | | |
|---|---|---|---|
| 1,227,573 | 5/1917 | Bole | 164/66.1 |
| 1,978,222 | 10/1934 | Otte | 164/66.1 X |
| 2,343,842 | 3/1944 | Hatcher | 164/66.1 |
| 3,174,200 | 3/1965 | Keel et al. | 164/66.1 |
| 3,392,009 | 7/1968 | Holmes et al. | 164/66.1 X |
| 3,451,594 | 6/1969 | Stewart | 164/475 X |

FOREIGN PATENT DOCUMENTS

| | | | |
|---|---|---|---|
| 677958 | 9/1966 | Belgium . | |
| 0000310 | 1/1979 | European Pat. Off. | 164/66.1 |
| 1137531 | 10/1962 | Fed. Rep. of Germany | 164/66.1 |
| 434070 | 1/1912 | France . | |
| 45-16926 | 6/1970 | Japan | 164/66.1 |
| 57-36046 | 2/1982 | Japan | 164/475 |
| 70560 | 11/1974 | Luxembourg . | |

OTHER PUBLICATIONS

*Chem. Abstr.*, vol. 92, 1980, p. 234, 92:114595c.

*Primary Examiner*—Nicholas P. Godici
*Assistant Examiner*—J. Reed Batten, Jr.
*Attorney, Agent, or Firm*—Browdy and Neimark

[57] ABSTRACT

Molten steel, normally exposed to an atmosphere of air, is protected against pick-up of impurities by placing carbon dioxide gas in such quantities and in such proximity to the surface to cause dissociation of the carbon dioxide at a rate which furnishes an atmosphere of carbon monoxide and gives off a negligible amount of oxygen to the steel, thus providing a gas barrier or shroud isolating the steel from the surrounding atmosphere and preventing pick-up therefrom of oxygen, nitrogen or hydrogen. This method may be applied to protecting steel being transferred from a ladle to a mold, or from a ladle to a tundish and from the tundish to a mold in continuous casting. In a method where a number of shrouding operations are carried out in series, carbon dioxide vapor, under pressure, is bled, in increments, from a storage vessel containing a body of liquid carbon dioxide in overlying ullage space containing vapor. Each increment is superheated, after it leaves the vessel, and is ultimately expanded and dispersed at ambient temperature to form the shroud. As each increment of vapor is removed from the vessel, it is replaced by withdrawing liquid carbon dioxide, vaporizing it and returning it to the ullage space.

6 Claims, 5 Drawing Figures

METHOD OF AND APPARATUS FOR CASTING METAL USING CARBON DIOXIDE TO FORM GAS SHIELD

BACKGROUND OF THE INVENTION

1. Field of the Invention

This invention relates to casting molten steel.

2. Description of the Prior Art

In normal practice, molten steel produced by any of the classic processes, for example, the B.0.F., the Q.B.0.P., or the electric furnace process, usually contains a high level of oxygen. This degrades the steel. To overcome this, the steel is killed by introducing into the molten steel deoxidizing agents, for instance, silicon, in the form of ferro silicon or aluminum or both. This is usually performed in a transfer ladle, at tap.

Following deoxidation treatment, the killed molten steel has a strong affinity for oxygen, which it picks up when exposed to the atmosphere, during pouring from a furnace, or casting into ingot molds, into billets, or into slabs. This results in defects, for example, non-metallic inclusions, in the resulting steel which can reduce the quality of the finished products.

To prevent or to reduce this "oxygen pick-up", various protective methods have been used. One involves shielding open cast steel streams between tundish and mold with ceramic tubes. This has been an established practice for maintaining high quality in continuous casting of large bloom and slab sections. It cannot be applied to smaller bloom and billet sections, however, because of space limitations. An example of this type of process is found in Canadian Pat. No. 1,097,881, Thalmann et al, Mar. 24, 1981.

In another expedient, liquid argon has been poured into ingot molds. The argon evaporates on contact with the molten steel and shields it from the atmosphere as it continues to be poured into the mold. Main drawbacks of this method are that the storage and transfer of equipment is difficult to adapt to the hard working conditions of the pouring floor, and, the cost of argon in relation to the price of normal grades of steel is high.

The inert gas shrouding of strand cast steel has also been described in the article "Gas Shrouding of Strand Cast Steel at Jones & Laughlin Steel Corporation" by Samways, Pollard & Fedenko, Journal of Metals, October 1974 pages 28–34. U.S. patents relating to this method are U.S. Pat. No. 3,908,734, Sept. 30, 1975, U.S. Pat. No. 3,963,224, June 15, 1976, and U.S. Pat. No. 4,023,614, May 17, 1977, all to Pollard.

Another method uses liquid nitrogen to form a shroud about the molten steel as it is teemed into a continuous casting machine. This is described in the brochure entitled "Conspal Surface Protection", published by Concast AG, Zurich, Switzerland, March 1977 and in U.S. Pat. No. 4,178,980 (1979), L'Air Liquide. In general, liquid nitrogen has provided a degree of protection which gives some improvement over other methods. But, handling this substance under the hard conditions of the pouring floor makes it difficult to provide continuity of flow, during the operation. Also, nitrogen has has a density close to that of air, reducing its ability to displace air effectively. Moreover, nitrogen inerting is not practicable for grades of steel where nitride formation is undesirable.

The disclosure of the publications and patents mentioned are hereby incorporated by reference.

SUMMARY OF THE INVENTION

The applicants have now found that, surprisingly, carbon dioxide may be effectively employed to form a gas shield in protecting molten steel from oxidation from the atmosphere, for example, in continuous casting, in ingot molding, and in tapping steel from a furnace.

Carbon dioxide has been used in shrouding molten metal like lead, zinc, copper, metals with a melting point lower than the temperature of dissociation of carbon dioxide. From thermodynamic considerations, it would be expected that, on contact of carbon dioxide with molten steel, the latter would be oxidized by the dissociation of the gas, because its dissociation temperature is well below that of molten steel (1600° C. to 1650° C.). However, the applicants have found, unexpectedly, the kinetics are such that on contact with gravitating streams of molten steel, while the carbon dioxide at the gas metal interface does dissociate, a very small amount of oxygen dissolves in the metal, and the carbon monoxide formed serves as a barrier layer at the gas metal interface. Not only is the oxidation considerably reduced to below the level it would reach if there were no barrier from the atmosphere, but pick-up by the molten steel of nitrogen and hydrogen (from moisture in the air) is also prevented. The pick-up of dissociated oxygen from the shrouding gas has been found to be less than about 70 parts per million and may be as low as 20 to 30 parts. The carbon dioxide is thus capable of providing an effective barrier between the molten steel and the surrounding atmosphere which drastically reduces the rate of further oxidation, to the point where this gas can be employed as a most effective shroud to protect molten steel being transferred from one vessel to another from contamination by air.

In carrying out the applicants' method, carbon dioxide gas is placed in such quantities and in such proximity to the surface of molten steel for such a time as to cause dissociation of the carbon dioxide at a rate which furnishes an atmosphere of carbon monoxide and gives off a negligible amount of oxygen to be picked up by the steel, thus providing a barrier which isolates the steel surface from the surrounding atmosphere and prevents pick-up therefrom of oxygen, nitrogen or hydrogen.

More specifically, in transferring molten steel from a higher vessel to a lower one, for example, in teeming from a ladle to a mold, an atmosphere of carbon dioxide is formed, in a shroud, about the liquid stream, near its source, to form a gaseous blanket which covers the surface of the steel until it solidifies. In the case of top poured ingot teeming into a mold, the mold is flushed, in advance, with carbon dioxide to remove the air and provide, in the mold, an atmosphere of carbon dioxide into and through which the steel is teemed. In this way, the oxygen content of the mold, prior to teeming, may be reduced substantially to a minimum, for example, to less than 3% by volume, preferably not more than 1%.

The flow rate should be not less than equivalent to about 2.2 cubic meters and preferably as much as 3.4 cubic meters per minute for flushing a mold having a volume of about 100 cubic feet. The lapse time between the end of the purge and the start of the teeming should be kept to a minimum and should not exceed about 35 seconds, and should preferably be between 20 and 30 seconds to insure that the atmosphere of carbon dioxide is substantially intact.

The shroud may be formed by providing a ring, with dispensing openings, about the molten steel stream, near its source at the outlet of the upper vessel, to supply the carbon dioxide in the proximity of the steel stream in the form of jets which merge into a blanket which surrounds the moving surface of the steel stream and is carried along with it. In the case of teeming into an ingot mold, a dispensing ring may surround the outlet nozzle of the teeming ladle. A similar arrangement may be employed, in continuous casting, in the transfer of the steel from the ladle to the tundish, and from the tundish to the mold. In transferring steel from a furnace to a ladle in a stream, appropriate dispensing means may be provided to supply carbon dioxide in proximity to the stream, to shroud it in an analogous manner.

BRIEF DESCRIPTION OF THE DRAWINGS

The invention will be illustrated in more detail by reference to the accompanying drawings, illustrating preferred embodiments, and in which.

DESCRIPTION OF PREFERRED EMBODIMENTS

Figure 1:
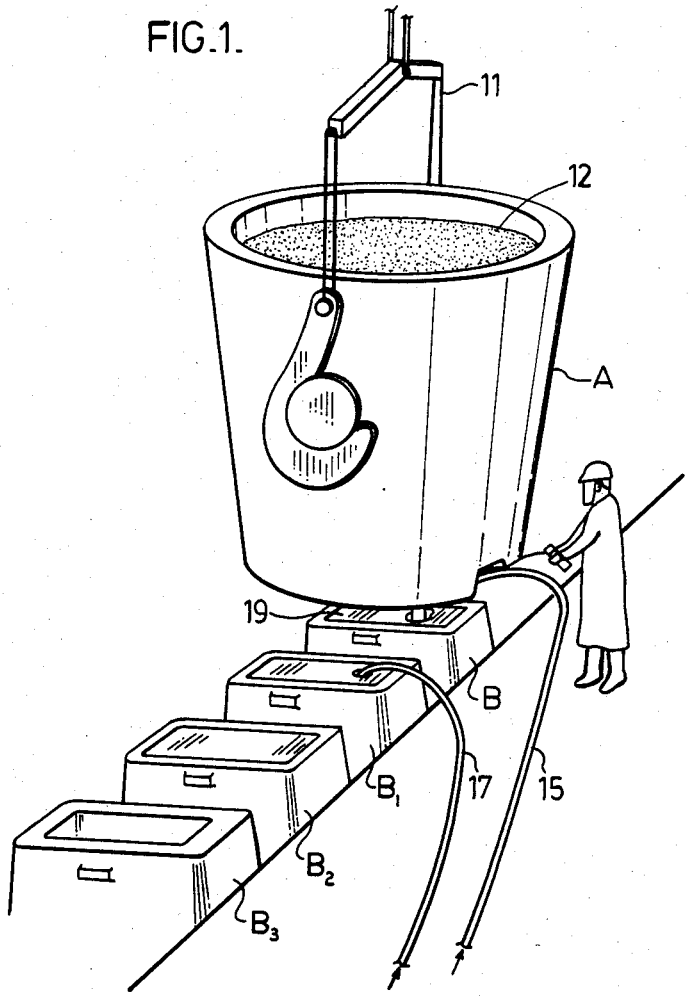
FIG. 1 is a perspective illustration showing the relationship between the ladle and a succession of molds, during the carrying out of a method, according to the invention.
Figure 3:
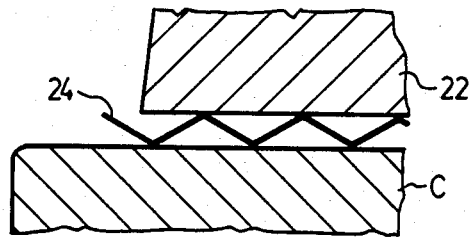
FIG. 3 is an enlarged fragmentary view showing a corrugated steel stand supporting the bottom of the mold.

Referring more particularly to the drawings, FIG. 1 shows a ladle A supported from above by suspending means 11 and containing molten steel 14 being teemed into a mold B. A layer 12 of slag tops the molten steel. Carbon dioxide shrouding gas is supplied through a dispensing collar (shown in FIG. 4) through a supply line 15.

A mold $B_1$, waiting its turn for receiving molten steel from the ladle is shown receiving purging carbon dioxide gas through a line 17 and subsequent molds $B_2$ and $B_3$ are awaiting their turn.

An aluminum foil cap 19 sits on top of each mold. The cap 19 is ruptured locally to provide an opening for the gas line.

Figure 2:
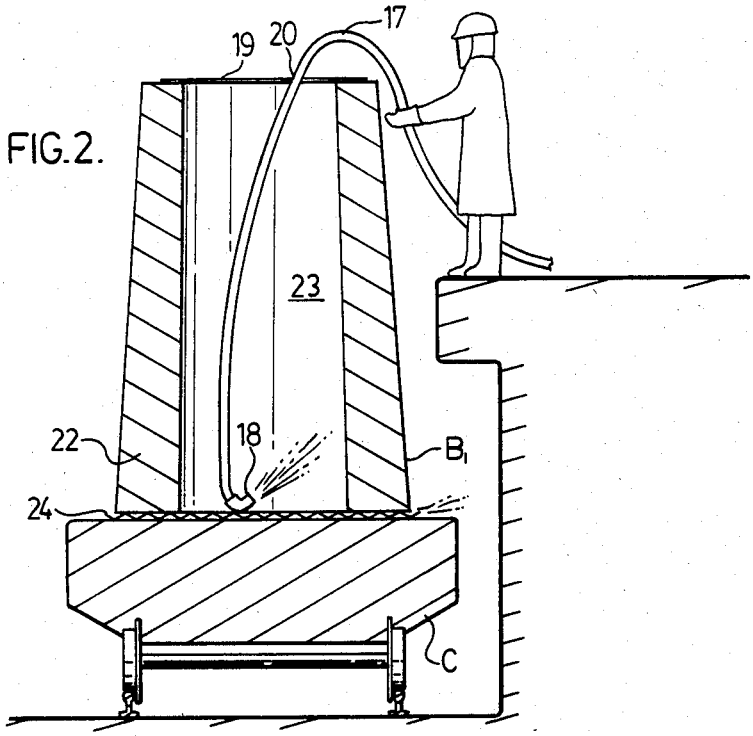
FIG. 2 is a vertical cross-section, partly in elevation, through a mold, in the course of being flushed with carbon dioxide, to prepare it for receiving molten steel from the ladle.

FIG. 2 shows, in more detail, the mold $B_1$, in the course of being flushed with carbon dioxide. The line 17 is passed through an opening 20 in the aluminum foil cap 19 and terminates in a nozzle 18 through which carbon dioxide is dispensed into the bottom of the mold to displace the air and replace it with an atmosphere of carbon dioxide which is maintained until just before teeming molten metal into that mold.

The mold $B_1$ has a wall 22, enclosing a tapered mold cavity 23. The bottom of the wall 22 sits on a corrugated metal stand 24 supported by the deck of a track mounted stool C to provide a seal between the bottom of the wall 22 and the surface of the deck of the stool C, allowing lateral escape of a certain amount of the carbon dioxide gas. The stool is used to carry the ingots out of the teeming bay.

Carbon dioxide is flushed into the mold $B_1$, until its oxygen content is reduced substantially to a minimum. For example, it has been found possible to reduce the oxygen content to less than 3% and even to not more than 1% by volume. The rate of flow of the flushing gas has to be unexpectedly high to compensate for the conditions encountered, for example, through heat of the mold and leaks beneath the mold at the base and between the top of the mold and the cover. The level of oxygen is maintained at substantially a minimum by continuing the flow of flushing gas just before teeming is started.

Figure 4:
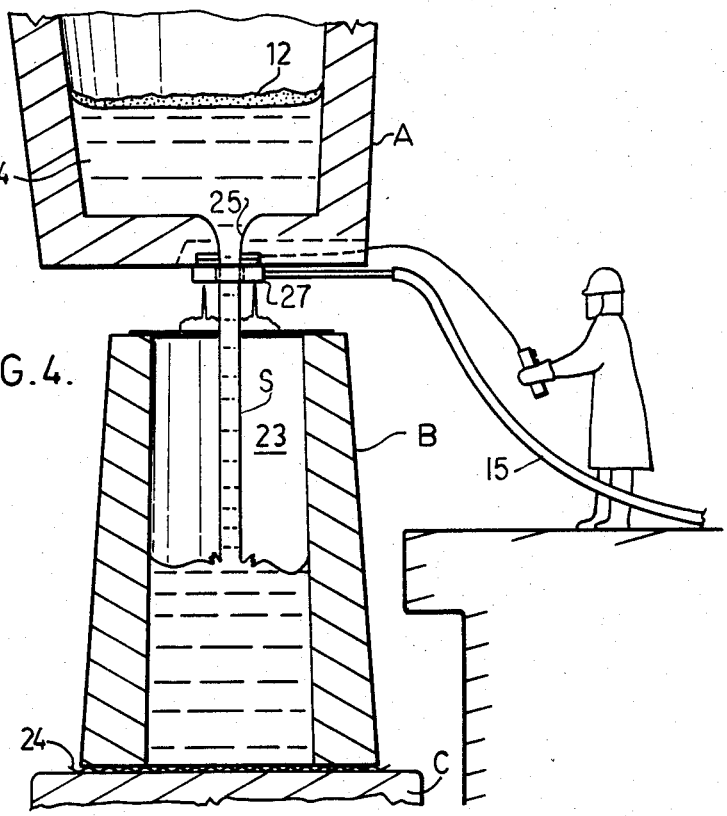
FIG. 4 is a vertical cross-section, partly in elevation, showing the mold and ladle during an ingot teeming operation.

The mold B and the ladle A are brought into teeming position and the teeming operation carried out as will be described in relation to FIG. 4. A slide gate in the mold B is opened by remote control allowing the molten steel to pass down through the outlet passage 25 in the ladle A and passed in the form of a vertical stream S, past a shroud diffuser 27. The stream leaving the ladle outlet 27 is circular in cross-section and of diameter 50 to 100 millimeters and of length between the outlet and $CO_2$ and the mold, which is 45 to 80 centimeters. In the case of continuous casting, the stream from ladle to tundish would have a diameter of about 50 millimeters to 100 millimeters and a length of 30 centimeters to 60 centimeters, whereas the length of the stream from the tundish to the casting mold would be from about 30 centimeters to about 45 centimeters.

The diffuser 27 is fed with gaseous carbon dioxide from a line 15, causing a shroud of gas to surround the stream of molten steel and to be drawn along with it to within the carbon dioxide atmosphere in the mold B. From the time it leaves the outlet of the ladle to the time it reaches its destination in the mold, the molten steel is screened from the atmosphere by a continuous curtain of gas as described above. Once the mold has been filled, the slide gate valve of the ladle is closed to cut off the flow of molten steel and the next mold $B_1$ and the ladle A brought into register for receiving its supply of molten steel.

Figure 5:
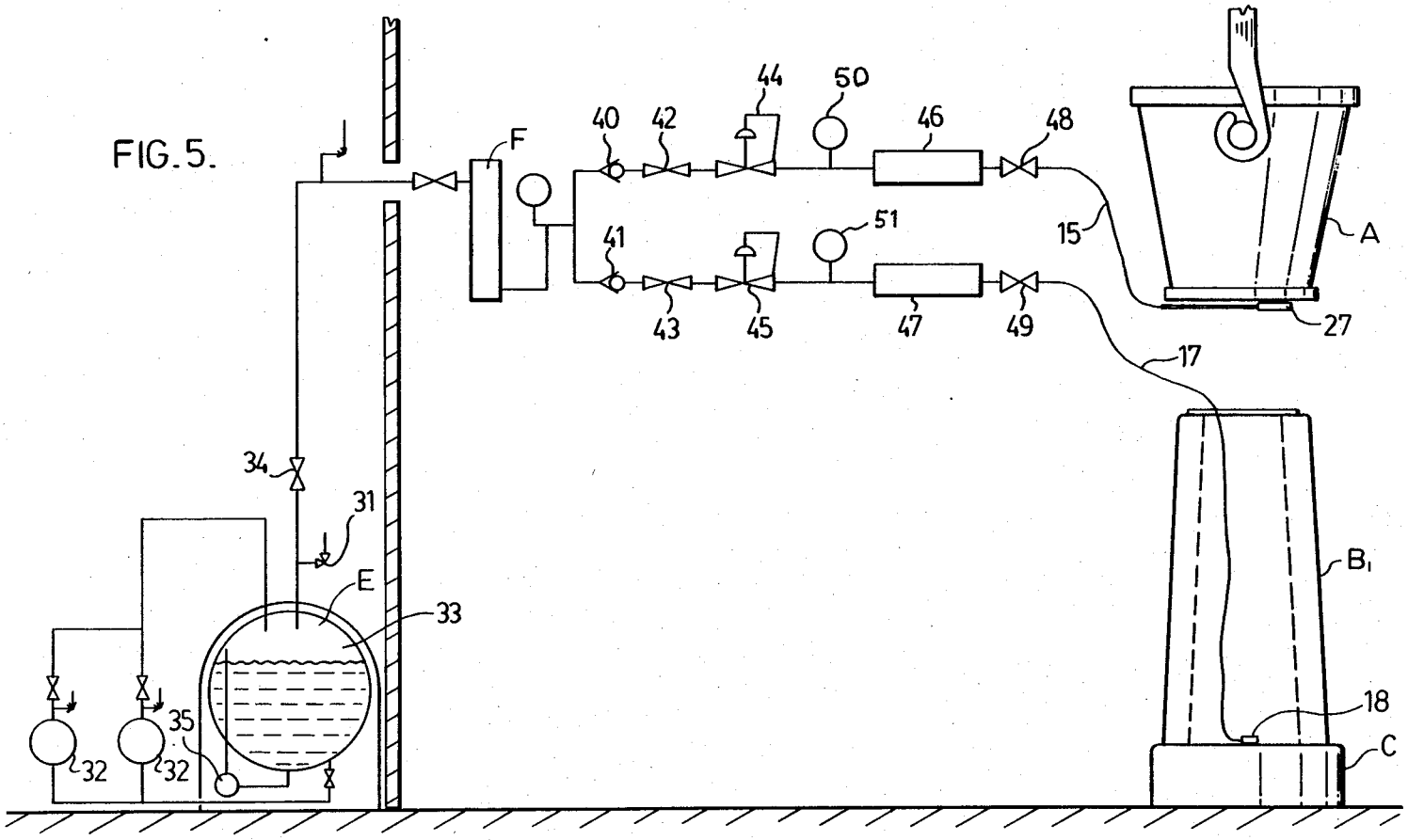
FIG. 5 is a diagram showing the arrangment of pieces of equipment suitable for supplying carbon dioxide for carrying out a method according to the invention, and the fluid connections between them.

The way in which the carbon dioxide is supplied is important to carrying out a number of shrouding operations one after the other. To this end, a preferred installation, as illustrated in FIG. 5, will be described as follows.

Liquid carbon dioxide is stored in an insulated refrigerated pressure vessel E at a temperature between about 17° and 18° C. and at a pressure of 20 kilos per square centimeter.

The vessel E is protected by a safety pressure relief valve 31, set at 24 kilos per square centimeter. Carbon dioxide is withdrawn as a vapor, from the ullage space 33 of the vessel E, through a block valve 34. Withdrawal of carbon dioxide vapor from the vessel E lowers the pressure in the ullage space 33. A vaporizer 35 is fed from an energy source (electric, hot water or steam) and is provided to vaporize liquid carbon dioxide and maintain the pressure within the ullage space 33 as carbon dioxide is withdrawn through the block valve 34 towards the point of use. Additional vaporizers 32 may be added in parallel to maintain the pressure in the ullage space under conditions of high withdrawal of carbon dioxide vapor through the block valve 34.

There is also a sensor (not shown) which senses the pressure in the ullage space 33. When the pressure falls below that described, then more vapor is supplied to the space 33 to restore the pressure. If the tank is left to stand, for any time, without dispensing vapor the heat increases and thus the pressure. A refrigerator (not shown) is then activated and the vapor cooled down.

Carbon dioxide vapor passes from the ullage space 33 to the block valve 34, at the pressure of the storage vessel (20 kilos per square centimeter) to an inline heater F, fed from an external energy source. It is the purpose of the heater F to add sensible heat to the carbon dioxide vapor so that it is at a temperature where it may subsequently be expanded without producing a temperature outside the operating range of the downstream equipment and which will ultimately dispense carbon dioxide gas at ambient temperature. The temperature to which the gas is heated in the heater may be within the range from 100° C. to 120° C.

The carbon dioxide vapor passes, at this temperature, from the inline heater F through check valves 40 and 41 and block valves 42 and 43 to pressure-reducing regulators 44 and 45 then through pressure gauges 50 and 51, flow meters 46 and 47, and control valves 48 and 49 to the respective diffusers 27 and 18. The pressure-reducing regulators 44 and 45 are set to a pressure which will give adequate flow for the downstream requirements.

Gas flow is indicated by the flow indicating devices or meters 46 and 47 and the flow of carbon dioxide is controlled by valves 48 and 49. Pressure gauges or indicators 50 and 51 are interposed between the regulators 44 and 45 and the respective meters 46 and 47. The temperature of the gas between the regulators 44 and 45 and the flow indicating devices 46 and 47 will be in the range from about 5° C. to about 15° C.

EXAMPLE

For the purpose of this example, equipment was employed substantially as shown in the drawings and operated substantially as described above. A ladle was employed, having a capacity of 120 tonnes and molds each having a volume of approximately 100 cu. ft. and a capacity of 8 to 9 tonnes so that each 120 tonne heat yielded 6 to 9 ingots. The ladle had a circular outlet or nozzle of diameter from 5 to 6.5 cm. Each mold produced ingots 270 cm. tall and had rectangular sections averaging 70×160 cm. The distance from the bottom of the outlet to the top of the mold was 75 cm. Each mold rested on a track-mounted stool (base plate) which is used to carry the solidified ingots out of the teeming bay.

The ladle was equipped with a perforated ring, just below the outlet, capable of forming a protective shroud of carbon dioxide gas. This ring was connected to a continuous source of supply of carbon dioxide gas as shown in FIG. 5. In addition, conventional apparatus was available for flushing the mold with carbon dioxide gas.

While the steel was in the furnace, the molds were being prepared for teeming, according to the following procedure. A strong jet of compressed air was applied to the stool to remove any loose particles. A coating dispersion, consisting of cement in dilute phosphoric acid was then applied to the stool. Four strips of corrugated steel sheet about 6"×30"×1/16" were placed in a square or oblong pattern on the stool to provide a stand. When the mold was placed in position on the stand, its weight deformed the corrugation to reduce the chances of molten steel leakage (see FIG. 2).

An oblong well made of light gauge steel sheet measuring approximately 20"×40"×50" was placed on the stool inside the mold to reduce the intensity of splashing when the first molten metal was teemed into the mold. Exothermic "boards" ("hot tops") were fixed on the top 12" of the inside of the mold which, upon contact with the molten steel generate heat that slows down the rate of cooling at the top of the ingot, thereby reducing the depth of the "pipe" in the top of this ingot which must be cropped before subsequent rolling. A cover of aluminum foil was placed on top of the mold to limit the exposure to atmosphere before the mold had been purged with carbon dioxide.

Air was displaced from inside the mold by carbon dioxide purging at a rate of 2.25 to 120 scfm for approximately 3 to 5 minutes before teeming each ingot. An asbestos protected rubber hose was introduced into the mold through the aluminum foil in such a way that the diffuser reached as far down as possible, as illustrated in FIG. 2. The flow of gas was continued until the air had been expelled from the mold, to the point where the oxygen concentration in the mold was not more than 1% by volume. The flushing continued until just prior to the teeming into that mold, to take care of gas leak between the mold and its stool.

At the start of teeming, the molten steel perforated a small hole in the aluminum foil, thus reducing the amount of ambient air drawn into the mold.

The temperature of the steel in the stream was within the range from 1625° C. to 1650° C.

During teeming to each mold, a shroud of carbon dioxide was formed near the source of the stream, i.e. just below the bottom of the ladle underneath the nozzle. The shroud formed about the stream of molten steel was entrained with it and formed a protective gas barrier from the atmosphere from the time it left the nozzle to the point of impact in the mold. The flow rate of carbon dioxide to the shroud was 2.8 cubic meters per minute.

The ladle containing the 120 tons of steel was positioned over the already purged first mold and the shroud gas flow was started. The purge hose had been transferred to the second mold without interrupting the gas flow.

The slide gate was opened to start teeming. The nozzle, at times, is blocked by either frozen metal or slag. In either case, oxygen lancing is required to clear the nozzle.

Although $CO_2$ was supplied in liquid form, gaseous $CO_2$ was used at both injection points (flushing and shrouding). A system was therefore employed which ensured a vaporization capability to provide a flow rate comparable to that of an inert gas, for example, argon. A $CO_2$ supply set-up similar to that shown in FIG. 5 was used.

The first ingot took the least time to fill since the metal head gradually decreased during teeming. In approximately 3 minutes, the mold was filled and the slide gate was closed (for about 20–30 seconds) while the overhead crane operator positioned the ladle over the second mold. The purging gas hose had meanwhile been transferred to the next mold and the slide gate was reopened to fill the mold that had just been purged. The sequence was continued until the ladle was emptied of its metal charge.

It was found that there was no significant increase over 1% oxygen by volume resulting in the first 45 seconds after carbon dioxide purging. The elapsed time between the end of the purge to the start of teeming averaged not more than 30 seconds with the exception of the first ingot which took slightly longer, but less than 45 seconds, because of the oxygen lancing of the teeming nozzle.

The charge in each mold was allowed to cool, in the classic way, with a protective flux on the surface, to form a solid ingot. The molds were then stripped from the ingots.

Quality of Steel

Each ingot was hot rolled into skelp, according to standard practice, and tested for surface defects. The acceptable skelp was then rolled into sheet and the sheet made into spirally welded pipe. The pipe was then subjected to sonic testing to reveal defects.

Control heats were then carried out, in an identical manner, using argon and carbon dioxide as shown in the table below.

The gas flow in the case of carbon dioxide was 2.8 cubic meters per minute and argon 2.8 cubic meters per minute. Each mold was flushed for about 3 minutes and the stream of molten metal was protected for the duration of the teeming operation, about 25 minutes.

A comparison of the results follows in terms of surface defects on skelp rolled from billets produced.

| Shrouding | Mold Flushing | Rejection rate % by Weight |
|---|---|---|
| Argon | Argon | 0.7 |
| Carbon dioxide | Carbon Dioxide | 0.55 |
| Argon | Carbon Dioxide | 0.43 |

Defects by Sonic Test on spiral welded pipe

| Shrouding | Mold Flushing | Rejection Rate % by Weight |
|---|---|---|
| Argon | Argon | 0.4 |
| Carbon dioxide | Carbon dioxide | 0.15 |
| Argon | Carbon Dioxide | 0.00 |

Because of the relatively low cost of carbon dioxide gas and its ready availability, as compared, for example, with argon or hydrogen, and the fact that the gas can be generated locally and supplied continuously makes it a most useful gas when used as described herein. Carbon dioxide is heavier than air (1.5:1) as against argon (1.25:1) and will therefore maintain an effective protection shroud longer than lighter gases because it will not disperse into the atmosphere as readily.

In carrying out a number of shrouding operations one after the other, despite the heavy drain on the carbon dioxide supply and its expansion when dispensed, the expedients described which differ from that of dispensing other shrouding gas, make it possible to maintain the gas at a temperature at which the equipment is protected and the carbon dioxide does not freeze.

The amount of oxygen in the starting steel, being teemed, would depend on the grade of steel and could amount to 400 parts per million to 1,900 parts per million. In a normal teeming operation, without shrouding, one would expect the oxygen pick-up in the steel to be between several thousand parts per million by volume. When the mold is flushed and the steel stream is shrouded with carbon dioxide, in accordance with the invention, the pick-up is no more than 70 ppm and can be as low as 20 to 30 ppm.

We claim:

1. A method of forming a gas shroud to protect against pick-up of impurities in molten steel having a surface exposed to an atmosphere of air, in a succession of operations, comprising, for a number of operations, in series, intermittently drawing carbon dioxide vapor in increments from the ullage space of a supply vessel containing a body of liquid carbon dioxide and an overlying mass of vapor, as each increment of vapor is withdrawn, renewing the vapor by withdrawing and vaporizing a corresponding part of the carbon dioxide in the vessel and recycling it into said ullage space, passing each increment of carbon dioxide through a heater to superheat it above ambient temperature, passing the heated increment of carbon dioxide through a regulating control valving mechanism and releasing the carbon dioxide as a gas through restricted dispensing passages at ambient temperature to form said shroud protecting the steel surface.

2. A method, as defined in claim 1, in which the shroud is formed to protect a liquid steel stream gravitating from an upper container to a lower one.

3. A method, as defined in claim 1, in which the steel in each operation is transferred from a ladle to a mold to form an ingot, the mold is first flushed by replacing its air content with carbon dioxide which forms a shroud within the mold and the carbon dioxide is also released to form a shroud over the surface of the stream of molten steel.

4. A method, as defined in claim 3, in which the carbon dioxide supply for shrouding the surface and for flushing, respectively, is through a different supply line having its own controls.

5. A method of carrying out a number of shrouding operations serially in which molten metal gravitates in a stream from an upper vessel to a lower vessel and a shroud is formed about the stream to protect it from the surrounding atmosphere, comprising, providing a supply of liquid carbon dioxide and an overlying supply of vapor in a vapor space in a pressure vessel under predetermined pressure, carrying out a number of shrouding operations in series by dispensing vapor from the vapor space in a continuous series of increments one to each operation in succession, each increment producing a pressure drop within the vessel, responsive immediately to the pressure drop caused by each burst withdrawing liquid carbon dioxide from the reservoir and passing it into the overlying supply of vapor until pressure equilibrium is restored and the vapor lost in the increment is replaced, superheating each increment of carbon dioxide leaving the pressure vessel, passing the heated increment through a pressure reducing regulator set at a pressure to give the desired flow rate for dispensing through control valves to the dispensing device for carrying out each operation.

6. An apparatus for carrying out a number of shrouding operations in series, in each operation a stream of steel being passed from an upper vessel to a lower vessel, comprising, an upper vessel having a bottom opening for forming a gravitating stream of steel, a pressure vessel for containing a body of liquid carbon dioxide covered by an atmpsphere of carbon dioxide gas, means defining a gas dispensing passage from the pressure vessel leading to dispensing means surrounding the bottom opening of the upper vessel, means for controlling the means defining the gas dispensing passage whereby carbon dioxide gas is dispensed from the pressure vessel in increments required for each shrouding operation, as carbon dioxide gas is withdrawn from the pressure vessel replacing it with liquid carbon dioxide, means for controlling the means defining the gas dispensing passage whereby the carbon dioxide gas is supplied in amounts suitable for forming the shroud, means for superheating the carbon dioxide gas leaving the pressure vessel, flow of carbon dioxide gas to the dispensing means, means for controlling the temperature to which the carbon dioxide gas is superheated, whereby when it is expanded in dispensing, the temperature is reduced to not less than ambient temperature so that the carbon dioxide is dispensed as a gas.

* * * * *

UNITED STATES PATENT AND TRADEMARK OFFICE

Certificate

Patent No. 4,614,216 Patented September 30, 1986

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is Guy Savard, Robert Lee, Guillermo Garrido and Alan Balding.

Signed and Sealed this 9th Day of December, 1986.

BRADLEY R. GARRIS,
*Office of the Deputy Assistant Commissioner for Patents.*